US008454299B2

(12) United States Patent
Higashimori et al.

(10) Patent No.: US 8,454,299 B2
(45) Date of Patent: Jun. 4, 2013

(54) RADIAL COMPRESSOR

(75) Inventors: Hirotaka Higashimori, Nagasaki (JP); Koichi Sugimoto, Nagasaki (JP); Hideyoshi Isobe, Nagasaki (JP); Takashi Shiraishi, Sagamihara (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 686 days.

(21) Appl. No.: 12/665,229

(22) PCT Filed: Feb. 19, 2009

(86) PCT No.: PCT/JP2009/053469
§ 371 (c)(1),
(2), (4) Date: Jan. 26, 2010

(87) PCT Pub. No.: WO2009/107689
PCT Pub. Date: Sep. 3, 2009

(65) Prior Publication Data

US 2010/0143095 A1 Jun. 10, 2010

(30) Foreign Application Priority Data

Feb. 29, 2008 (JP) ..... 2008-050803

(51) Int. Cl.
*F04D 29/68* (2006.01)

(52) U.S. Cl.
USPC ..... 415/58.4; 415/206; 415/914

(58) Field of Classification Search
USPC ..... 415/58.4, 206, 914
See application file for complete search history.

(56) References Cited

U.S. PATENT DOCUMENTS

| | | | | |
|---|---|---|---|---|
| 4,930,978 | A | 6/1990 | Khanna et al. | |
| 4,990,053 | A * | 2/1991 | Rohne | 415/58.4 |
| 5,863,178 | A * | 1/1999 | Scheinert et al. | 415/58.4 |
| 6,447,241 | B2 * | 9/2002 | Nakao | 415/1 |
| 7,775,759 | B2 * | 8/2010 | Sirakov et al. | 415/1 |

FOREIGN PATENT DOCUMENTS

| | | | |
|---|---|---|---|
| JP | 58-18600 | A | 2/1983 |
| JP | 2-136598 | A | 5/1990 |
| JP | 2003-106293 | A | 4/2003 |
| JP | 2004-27931 | A | 1/2004 |
| JP | 2007-127109 | A | 5/2007 |
| WO | WO-2007/009766 | A1 | 1/2007 |

* cited by examiner

*Primary Examiner* — Ninh H Nguyen
(74) *Attorney, Agent, or Firm* — Birch, Stewart, Kolasch & Birch, LLP

(57) ABSTRACT

A radial compressor includes an impeller which is rotatively driven, axially introduces air taken in through an air inlet passage formed in a housing, pressurizes the introduced air, and discharges the pressurized air in a radial direction, wherein an annular concave groove is formed in a peripheral wall of the air inlet passage of the housing, a rear end portion of an opening of the annular concave groove, which rear end portion meets the housing peripheral wall, is provided in the vicinity of a blade front end surface of the impeller, and the rear end portion of the opening of the annular concave groove is formed such that an axial projecting amount X thereof relative to the blade front end surface of the impeller is set to $-1T \leqq X \leqq 1.5T$ (where T denotes the thickness of the distal portion of a blade).

4 Claims, 8 Drawing Sheets

(A)

(B)

(A)

(B)

(C)

RADIAL COMPRESSOR

TECHNICAL FIELD

The present invention relates to a radial compressor which is used with a pneumatic device or the like of a compressor of an exhaust turbo-charger of an internal combustion engine, and provided with an impeller which is rotatively driven to axially introduce air taken in through an air passage formed in a housing and which pressurizes the introduced air, then discharges the pressurized air in the radial direction, wherein an annular concave groove is formed in the peripheral wall of the air passage of the housing and an opening rear end portion of the annular concave groove which meets the housing peripheral wall of the annular concave groove is provided in the vicinity of a front end surface of a blade of the impeller.

BACKGROUND ART

FIG. 6 is a sectional view along a rotational axis line illustrating a conventional example of a radial-flow type exhaust turbo-charger with the aforesaid radial compressor built therein.

Referring to FIG. 6, reference numeral 10 denotes a turbine casing and reference numeral 11 denotes a scroll formed spirally around the outer periphery of the turbine casing 10. Reference numeral 12 denotes a radial-flow type turbine rotor provided coaxially with an impeller 8, and a turbine shaft 12*a* thereof is rotatively supported by a bearing housing 13 through the intermediary of a bearing 16.

Reference numeral 7 denotes a compressor housing which accommodates the impeller 8, reference numeral 9 denotes an air inlet passage of the compressor housing 7, and reference numeral 7*a* denotes a spiral air passage. Reference numeral 4 denotes a diffuser. These components constitute a radial compressor 100. Further, reference numeral 100*a* denotes a rotational axis center of the exhaust turbo-charger.

When the exhaust turbo-charger constituted as described above operates, an exhaust gas from an engine (not shown) enters the scroll 11, flows from the scroll 11 into a turbine rotor 12 from the outer periphery side thereof, and flows in a radial direction toward a central side to impart dilatational work on the turbine rotor 12. Thereafter, the exhaust gas flows out in the axial direction and is sent out of the exhaust turbo-charger by being guided to a gas outlet 10*a*.

The rotation of the turbine rotor 12 causes the impeller 8 of the radial compressor 100 to rotate through the intermediary of the turbine shaft 12*a*. The air taken in through the air inlet passage 9 of the compressor housing 7 is pressurized by the impeller 8, and then the pressurized air is supplied to the engine (not shown) through the air passage 7*a*.

The radial compressor 100 of the exhaust turbo-charger described above can be stably operated according to a relationship between a choke flow rate and a surge flow rate of air, as illustrated in FIG. 10(B). However, the range of flow rate permitting the stable operation is limited, so that it is necessary to operate the radial compressor 100 at a low-efficiency operating point away from a surge flow rate so as not to induce surging during a transient change at a rapid acceleration.

The radial compressor 100 presents a significant drawback in that the flow rate range between the choke flow rate and the surge flow rate becomes narrow, as illustrated in FIG. 10(B), due to the occurrence of the surging.

The surging is caused by a stall of a flow at an inlet of the impeller 8 or by a stall of the diffuser 4.

The flow at the inlet of the impeller 8 of the radial compressor 100 changes with flow rate. As illustrated in FIG. 10(B), the stable operation is performed according to the relationship between the choke flow rate and the surge flow rate; however, the stable operation cannot be performed at a flow rate of the surge flow rate or less.

At a normal operating point, as illustrated in FIG. 10(C1), a flow smoothly comes in between blades 8*a* of the impeller 8 along the contours of the front ends of the blades 8*a* of the impeller 8. However, at the surge flow rate, a stall 9*a*' of the flow at the front ends of the blades 8*a* takes place, as illustrated in FIG. 10(C2). The stall 9*a*' of the flow at the front ends of the blades 8*a* of the impeller 8 is one of the causes of the occurrence of surging.

The occurrence of surging is generally attributable to the stall 9*a*' in the impeller 8 or the stall of the diffuser 4. The present invention is focused mainly on the improvement of the surging (a reduction in a surge flow rate) attributable to the impeller 8.

As a means for preventing the occurrence of the surging, there has been one proposed in Patent Document 1 (Japanese Patent Application Laid-Open No. 58-18600).

FIGS. 8(A), (B), and (C) illustrate flows in the vicinity of surging which has occurred in the current impeller 8. As the flow rate reduces due to a stall at the inlet of the blade 8*a* of the impeller 8, an incidence angle w of the flow increases and a flow 9*f* begins to come in from an upstream of the blade 8*a* toward a pressure plane, as illustrated in FIG. 8(B). This flow leads to the occurrence of the so-called stall phenomenon in which the flow 9*f* breaks away on a negative pressure plane when the aforesaid flow turns in to the front end of the blade 8*a* (a backflow takes place on the negative pressure plane).

The stall phenomenon at the blade 8*a* causes a further increase in the incidence angle w of a flow coming to a blade 8*a*', which is on the reverse rotation side from the blade 8*a*, resulting in larger separation on the blade 8*a'*. This phenomenon is propagated to the blade 8*a'* on the reverse rotation side and a backflow 9*g* occurs also on a negative pressure plane by a backflow 9*h* reaching the negative pressure plane from a pressure plane 8*a*1 beyond the front end of the blade 8*a*, as illustrated in FIG. 8(C).

Thus, the stall phenomenon of the impeller 8 expands with a consequent pressure drop of the impeller 8, and surging takes place.

As a means for preventing the occurrence of the surging, there has been one proposed in Patent Document 1 (Japanese Patent Application Laid-Open No. 58-18600). In the means, as illustrated in FIGS. 9(A) and (B), an annular concave groove 7*b* is formed in the peripheral wall of the air inlet passage 9 of the compressor housing 7, and a rear end portion of an opening of the annular concave groove 7*b* which meets a housing peripheral wall 3 of the annular concave groove 7*b* is provided such that the rear end portion extends over a blade front end surface 1 of the impeller 8. The rear end portion of the opening of the annular concave groove 7*b* is provided at a downstream of the front end surface of the impeller so as to allow a circulating flow 18' to pass by the distal end of the impeller between the front end surface of the impeller and the rear end of the impeller.

In this case, as illustrated in FIG. 9(A), in the case where the rear end portion of the opening of the annular concave groove 7*b* is provided so as to extend over the blade front end surface 1 of the impeller 8, and the radius of the housing peripheral wall 3 of the air inlet passage 9 agrees with the radius of a peripheral wall 3' of a casing at the outlet side of the annular concave groove 7*b*, a backflow vortex 18' passing by the blade distal end at the downstream of the blade front end surface occurs due to a centrifugal force in a small-flow-rate area.

Further, as illustrated in FIG. 9(B) (FIG. 17 in Patent Document 1), providing the rear end portion of the opening of the annular concave groove 7*b* such that it extends over the blade front end surface 1 of the impeller 8 and setting the radius of the housing peripheral wall 3 of the air inlet passage 9 of the annular concave groove to be larger by U than the radius of the peripheral wall 3' of the casing on the outlet side balances a centrifugal force and the dynamic pressure on the upstream side by a design flow rate. This ensures smooth flow of a mainstream.

In this case, the rear end portion of the opening of the annular concave groove 7*b* is provided such that it extends over the blade front end surface 1 of the impeller 8. A relationship is illustrated that the blade front end surface 1 of the impeller 8 extends over the rear end portion of the opening of the annular concave groove 7*b*, and the blade distal end portion is configured so as to allow a circulating flow to pass thereby. This poses a drawback in that performance deteriorates at a normal operating point.

DISCLOSURE OF INVENTION

The present invention has been made with a view of the above problems with the prior art described above, and an object thereof is to provide a radial compressor capable of preventing the occurrence of separation caused by a flow which goes beyond a front end of a blade from a pressure plane onto a negative pressure plane, thereby making it possible to reduce a surging flow rate to a smaller flow rate.

To this end, there is provided a radial compressor provided with an impeller which is rotatively driven, axially introduces air taken in through an air passage formed in a housing, pressurizes the introduced air, and discharges the pressurized air in a radial direction, an annular concave groove being formed in a peripheral wall of the air passage of the housing, wherein a rear end portion of an opening of the annular concave groove, which rear end portion meets the housing peripheral wall, is provided in the vicinity of a blade front end surface of the impeller and the rear end portion of the opening of the annular concave groove is formed such that an axial projecting amount X thereof relative to the blade front end surface of the impeller is defined by $-1T \leqq X \leqq 1.5T$ (where T denotes the thickness of the distal portion of a blade).

The radial compressor in accordance with the present invention is further constructed as follows:

(1) The section of the rear end portion of the opening of the annular concave groove including an axis is formed such that a rear end internal surface of the annular concave groove and the peripheral wall surface of the housing are connected, forming a pointed end of an acute angle, and that a meeting angle $\alpha$ formed by the rear end internal surface of the rear end of the annular concave groove and the inner peripheral wall of the housing at the connected portion is 0° or more but does not exceed 45°.

(2) The thickness of the projecting end of the connected portion of the rear end internal surface of the annular concave groove and the peripheral wall surface of the housing is set to not less than 1T and not more than 1.5T.

Further, the radial compressor in accordance with the present invention may be constructed as follows.

The annular concave groove is preferably formed in the inner peripheral portion of an annular component having a recirculation passage formed on the outer periphery side thereof, the recirculation passage connecting an opening that opens to the outer periphery of a middle portion of an outlet of the impeller and an opening that opens to an outer peripheral portion at an upstream side beyond a blade front end surface at the outlet of the impeller.

Further, the present invention includes a radial compressor which has the aforesaid annular concave groove structure and which is constructed such that the annular concave groove and an upstream end wall thereof formed in the inner peripheral wall of the housing share an upstream-side wall surface of the opening on the upstream side of the impeller of the recirculation passage.

The present invention provides the following advantages.

An annular concave groove is formed in the peripheral wall of the air passage of the housing, the rear end portion of the opening of the annular concave groove, which rear end meets the housing peripheral wall, is provided in the vicinity of a blade front end surface of the impeller, and the section, which includes an axis, of the rear end portion of the opening of the annular concave groove is formed such that a rear end internal surface of the annular concave groove and the peripheral wall surface of the housing are connected, forming a pointed end of an acute angle, and the thickness of the projecting end of the connected portion of the rear end internal surface of the annular concave groove and the peripheral wall surface of the housing is set to 1.5T or less. Therefore, a flow turning around the front edge of a blade is guided to the annular concave groove provided above and adjacently to the front edge of the blade so as to prevent the separation of the flow onto a negative pressure plane of an impeller blade.

The one disclosed in Patent Document 1 (Japanese Patent Application Laid-Open No. 58-18600) aims at the effect for preventing surging by applying a shape similar to the above to an annular concave groove, but has a drawback in that a vortex moving upward, passing a blade and the distal end of the blade is generated even at a normal operating point, causing deteriorated efficiency.

To improve the drawback, according to the present invention, the rear end portion of the opening of the annular concave groove is formed such that an axial projecting amount X thereof relative to the blade front end surface of the impeller is defined by $X \leqq 1.5T$ (where T denotes the thickness of the distal portion of a blade), and provided adjacently to the position of the front edge of the impeller. Incidentally, $-1T \leqq X$ denotes an allowable value at fabrication.

With this arrangement, when an air flow taken in through the air passage moves in toward a blade of the impeller with an incidence angle and moves around the blade front end surface of the blade, a turning velocity which is approximately the same as a turning velocity of the blade is generated. The turning velocity produces a centrifugal force. The centrifugal force produced by the turning velocity is utilized to guide the flow which has obtained the turning velocity into the annular concave groove.

The one disclosed in Patent Document 1 (Japanese Patent Application Laid-Open No. 58-18600) described above also aims at the prevention of a stall of a flow by utilizing the aforesaid action, but has a shortcoming in that a flow running along a pressure plane of a blade obtains a turning velocity in the same manner also at a normal operating point, so that the flow passes the distal end of a blade due to a centrifugal force and goes into the annular concave groove, adding to a recirculation amount. Hence, the friction onto the wall surface in the annular concave groove increases and the recirculation of the flow provokes a mixing loss from the mixture with a flow coming from an upstream to the blade, resulting in deteriorated efficiency.

According to the present invention, the axial projecting amount X thereof relative to the blade front end surface of the impeller is defined by X≦1.5T (where T denotes the thickness of the distal portion of a blade), the section, which includes an axis, of the rear end portion of the opening of the annular concave groove and the peripheral wall surface of the housing are connected, forming a pointed end with an acute angle, and that a meeting angle α formed by the rear end of internal surface of the annular concave groove and the inner peripheral wall surface of the housing at the connected portion is not less than 0° and not more than 45°.

In the prior art, a flow that goes around the front edge of the blade causes a shortcoming in which a flow arising therefrom leads to a small-scale separation and also to a larger-scale separation on a reversely rotating blade, leading to surging.

Therefore, to avoid the aforesaid shortcoming, the axial projecting amount X relative to the blade front end surface of the impeller is set to a magnitude defined by X<1.5T (where T denotes the thickness of the distal end portion of a blade). This causes a flow that goes around the blade front edge to run into the annular concave groove due to the action of a centrifugal force. In other words, the action of the centrifugal force creates a condition for the flow to move to a radial outer side into the annular concave groove without going beyond the front edge of the blade and moving from the pressure plane onto the negative pressure plane.

Reversely from the above, if the axial projecting amount is set to be larger than X>1.5T and if the meeting angle α at the connected portion exceeds 45°, then a flow 9*a* in the vicinity of the annular concave groove of the housing peripheral wall will stagnate like 9*b*, as illustrated in FIG. 7, and the pressure at that portion will increase to a stagnant pressure, so that a flow 9*x*, which turns around the front edge of the blade will be pushed back by the pressure, and moves back toward the blade, thus preventing an expected effect from being obtained.

With the construction described above, the present invention makes it possible to prevent the separation caused by a flow running around the front edge of a blade from increasing the separation at the reversely rotating blade, thus allowing a surge flow rate to be smaller.

Further, in the present invention, the annular concave groove is formed in the inner peripheral portion of an annular component having a recirculation passage formed on the outer periphery side thereof, the recirculation passage connecting an opening that opens to the outer periphery of a middle portion of an outlet of the impeller and an opening that opens to an outer peripheral portion at an upstream side beyond a blade front end surface at the outlet of the impeller, and the axial projecting amount X of the rear end portion of the annular concave groove is set according to −1T≦X≦1.5T (where T denotes the thickness of the distal portion of a blade), or the section, which includes the axis, of the rear end portion of the opening of the annular concave groove is formed such that a rear internal surface of the annular concave groove and the peripheral wall surface of the housing are connected, forming a pointed end of an acute angle, and the meeting angle α formed by the rear end internal surface of the rear end of the annular concave groove and the inner peripheral wall of the housing at the connected portion does not exceed 45°, or the thickness of the projecting end of the connected portion of the rear end internal surface of the annular concave groove and the peripheral wall surface of the housing is set to 1.5T or less.

Thus, according to the invention described above, the stagnant pressure at the inlet of the recirculation passage is reduced, allowing a flow to easily run into the recirculation passage, and the effect for reducing the pressure in the recirculation passage is obtained with resultant improved recirculation efficiency.

BEST MODE FOR CARRYING OUT THE INVENTION

The following will explain in detail the present invention by using embodiments illustrated in the accompanying drawings. However, the dimensions, materials, and shapes of components and the relative arrangements thereof and the like described in the embodiments are not intended to limit the scope of the invention only thereto and are merely explanatory examples, unless otherwise specified.

First Embodiment

FIG. 1(A) is a sectional view of an essential section of a radial compressor of an exhaust turbo-charger according to a first embodiment of the present invention, and FIG. 1(B) is an enlarged view of portion Z in FIG. 1(A). FIG. 2 is a fragmentary view taken at line B-B in FIG. 1(A), and FIG. 3 is a fragmentary view taken at line A-A in FIG. 1(A).

Figure 1:
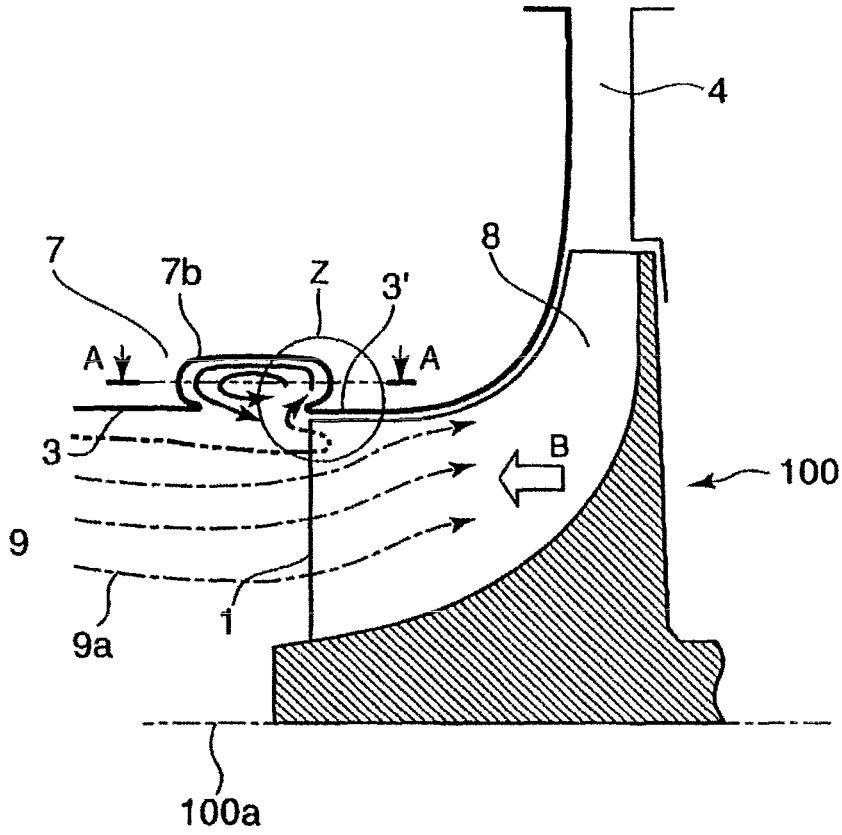
FIG. 1(A) is a sectional view of an essential section of a radial compressor of an exhaust turbo-charger according to a first embodiment of the present invention, and (B) is an enlarged view of portion Z in (A)
Figure 1:
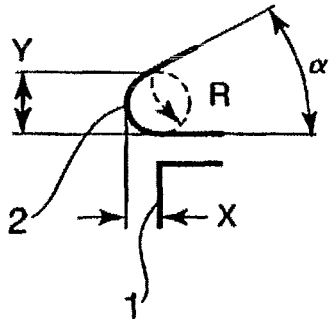
Figure 2:
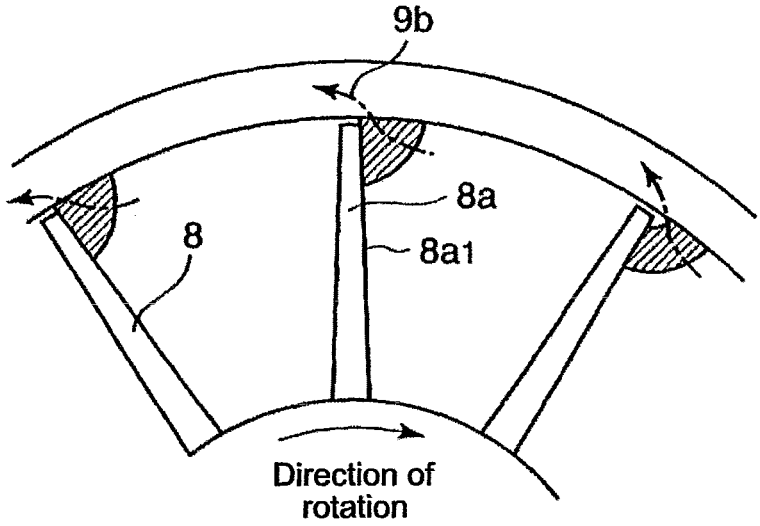
FIG. 2 is a fragmentary view taken at line B-B in FIG. 1(A) in the first embodiment.
Figure 3:
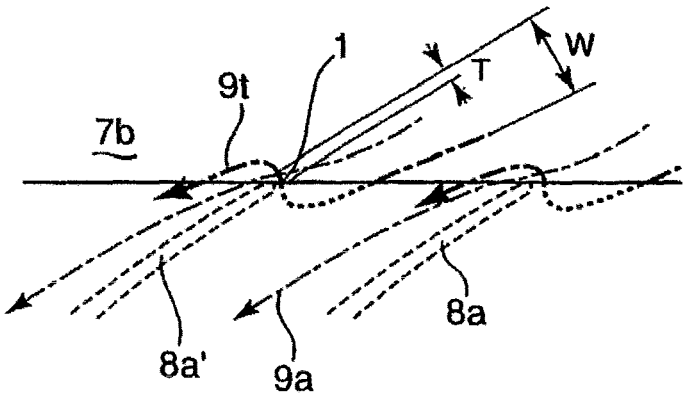
FIG. 3 is a fragmentary view taken at line A-A in FIG. 1(A) in the first embodiment.

In FIGS. 1 to 3, reference numeral 7 denotes a compressor housing in which an impeller 8 is accommodated, reference numeral 9 denotes an air inlet passage of the compressor housing 7, and reference numeral 4 denotes a diffuser. These components constitute a radial compressor 100. Further, reference numeral 100*a* denotes a rotational axial center of an exhaust turbo-charger.

An annular concave groove 7*b* having an elliptical section is formed in a housing peripheral wall 3 of the air inlet passage 9 of the compressor housing 7, and an opening rear end portion 2 of the annular concave groove 7*b* which meets the housing peripheral wall 3 is provided adjacently to a blade front end surface 1 of the impeller 8.

In this case, according to this embodiment, the housing peripheral wall 3 of the air inlet passage 9 and a peripheral wall 3' of a casing at the outlet of the annular concave groove 7*b* are formed such that the size of the radii thereof conform with each other.

The annular concave groove 7*b* formed in the housing peripheral wall 3 of the air inlet passage 9 of the compressor housing 7 has an opening rear end portion 2 thereof provided in the vicinity of the blade front end surface 1 of the impeller 8. As illustrated in FIG. 1(B), an axial projecting amount X of the opening rear end portion 2 of the annular concave groove 7*b* relative to the blade front end surface 1 of the impeller 8 is $-1T<X<1.5T$, where T denotes the thickness of a blade distal end portion.

Further, the axial section of the opening rear end portion 2 of the annular concave groove 7*b* in the axial direction is shaped such that a spherical surface having a radius Y is formed, connecting the inner surface of the annular concave groove 7*b* and the housing peripheral wall 3, and a meeting angle $\alpha$ of the connected portion does not exceed 45°, as illustrated in FIG. 1(B).

Further, the thickness of a projecting end of the connected portion of the rear end inner surface of the annular concave groove 7*b* and the housing peripheral wall surface, that is, the thickness of the opening rear end portion 2 illustrated in FIG. 1(B), is always maintained to be 1.5T or less.

Figure 6:
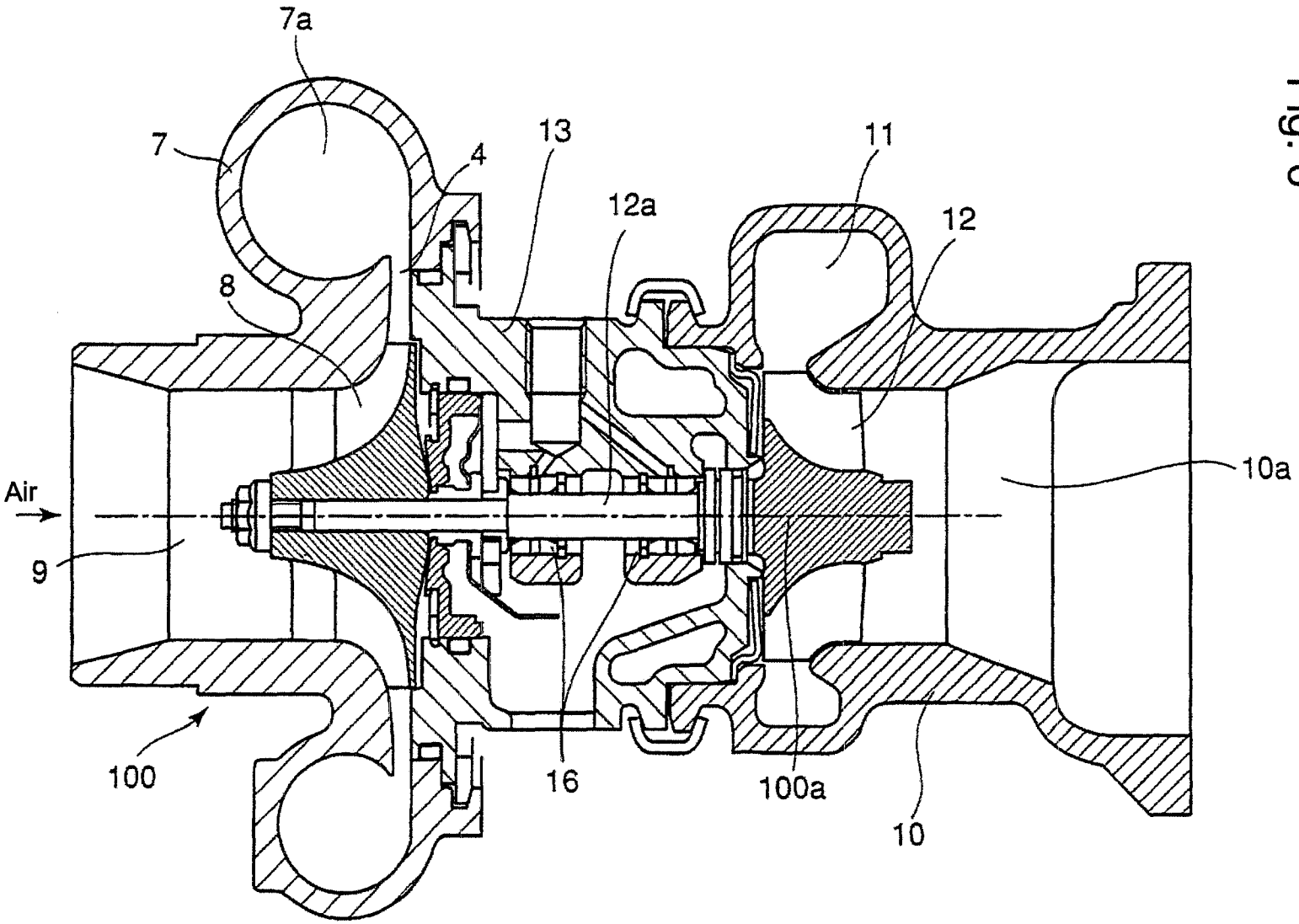
FIG. 6 is a sectional view along a rotational axis line, illustrating a conventional example of a radial flow type exhaust turbo-charger to which the present invention is applied.

When the exhaust turbo-charger constructed as described above is operated, the rotation of the turbine rotor 12 (refer to FIG. 6) driven by an exhaust gas from an engine (not illustrated) causes the impeller 8 of the radial compressor 100 to rotate through the intermediary of a turbine shaft 12*a* to pressurize the air taken in through the air inlet passage 9 of the compressor housing 7 by the impeller 8, then the compressed air is supplied to the engine (not illustrated) through an air passage 7*a*.

According to the embodiment described above, the radial compressor is provided with the impeller 8 which is rotatively driven to introduce, in an axial direction, an air flow 9*a* taken in through the air inlet passage 9 formed in the compressor housing 7, pressurizes the air 9*a* and discharges the pressurized air 9*a* in the radial direction, wherein the annular concave groove 7*b* is formed in the housing peripheral wall 3 of the air inlet passage 9 of the compressor housing 7, and the opening rear end portion 2 of the annular concave groove 7*b*, which meets the housing peripheral wall 3, is provided in the vicinity of the blade front end surface 1 of the impeller 8. The axial projecting amount X of the opening rear end portion 2 of the annular concave groove 7*b* relative to the blade front end surface 1 of the impeller 8 is defined by $-1T<X<1.5T$ (where T denotes the thickness of the blade distal end portion), and further, the axial section of the opening rear end portion 2 of the annular concave groove 7*b* in the axial direction is shaped such that the spherical surface having the radius Y is formed, connecting the inner surface of the annular concave groove 7*b* and the housing peripheral wall 3, and the meeting angle $\alpha$ of the connected portion does not exceed 45°. Further, the thickness of the projecting end of the connected portion of the rear end inner surface of the annular concave groove 7*b* and the housing peripheral wall surface, that is, the thickness of the opening rear end portion 2, is always maintained to be 1.5T or less. Hence, the following advantages are provided.

The annular concave groove 7*b* is formed in the air inlet passage 9 of the compressor housing 7, and the opening rear end portion 2 of the annular concave groove 7*b*, which meets the housing peripheral wall 3, is provided in the vicinity of the blade front end surface 1 of the impeller 8 to guide a flow turning around the blade front end into the annular concave groove 7*b* provided above adjacently to the blade front end, thus making it possible to prevent the separation of a flow on the negative pressure plane of a blade of the impeller 8.

The one disclosed in Patent Document 1 (Japanese Patent Application Laid-Open No. 58-18600) described above also aims at a preventive effect against surging by applying a shape similar to the above to the annular concave groove 7*b*, but this is disadvantageous in that a vortex moving upward, passing a blade and the distal end of the blade, is generated even at a normal operating point, leading to deteriorated efficiency.

To improve the disadvantage, according to the present embodiment, the opening rear end portion 2 of the annular concave groove 7*b* is formed such that the axial projecting amount X thereof relative to the blade front end surface 1 of the impeller 8 is defined by $X \leqq 1.5T$ (where T denotes the thickness of the distal portion of a blade), as described above, and provided adjacently to the position of the front edge of the impeller 8. Incidentally, $-1T \leqq X$ defines an allowable value at fabrication.

With this arrangement, the air flow 9*a* taken in through the air inlet passage 9 goes in to a blade 8*a* of the impeller 8 with an incidence angle w (refer to FIG. 3), and a turning velocity, which is approximately the same as a turning velocity of the blade 8*a*, is generated when a flow 9*t* moves around the blade front end surface 1 of the blade 8*a*, as illustrated in FIG. 3. The turning velocity produces a centrifugal force. The centrifugal force produced by the turning velocity is utilized to guide the flow which has obtained the turning velocity into the annular concave groove 7*b*.

Further, as illustrated in FIG. 2, a flow 9*b* generated on a pressure plane 8*a*1 of the blade 8*a* is also sent into the annular concave groove 7*b* by a centrifugal force.

The one disclosed in Patent Document 1 (Japanese Patent Application Laid-Open No. 58-18600) described above also aims at the prevention of a stall of a flow by utilizing the above-mentioned action, but has a shortcoming in that a flow running along a pressure plane of a blade obtains a turning velocity in the same manner also at a normal operating point, so that the flow passes the distal end of the blade and goes into the annular concave groove due to a centrifugal force, adding to a recirculation amount, so that the friction onto the wall surface in the annular concave groove 7*b* increases, and the flow recirculates, provoking a mixing loss from the mixture with a flow coming from an upstream into the blade 8*a*, with consequent deteriorated efficiency.

On the other hand, in the first embodiment of the present invention, the axial projecting amount X relative to the blade front end surface 1 of the impeller 8 is set to be $X<1.5T$ (where T denotes the thickness of a blade distal end portion 8*b*), and further, the axial section of the opening rear end portion 2 of the annular concave groove 7*b* in the axial direction is shaped such that the spherical surface having the radius Y is formed, connecting the inner surface of the annular concave groove 7*b* and the housing peripheral wall 3, the meeting angle $\alpha$ of the connected portion does not exceed 45°. In addition, the thickness of the projecting end of the connected portion of the rear end inner surface of the annular concave groove 7*b* and the housing peripheral wall surface, that is, the thickness of the opening rear end portion 2 is always maintained to be 1.5T or less.

In the prior art, a flow that goes around the front end surface 1 of the blade 8*a* causes a shortcoming in which a flow arising therefrom leads to a small-scale separation and also to a larger-scale separation on a reversely rotating blade 8*a*' with consequent surging.

Therefore, to avoid the aforesaid shortcoming, the axial projecting amount X relative to the blade front end surface 1 of the impeller 8 is set to a magnitude defined by X<1.5T. This causes the flow 9*t*, which goes around the blade front end surface 1, to flow into the annular concave groove 7*b* due to the action of a centrifugal force. In other words, the action of the centrifugal force creates a condition for the flow 9*t* to move out into the annular concave groove 7*b* without passing the blade distal end due to the action of the centrifugal force.

Figure 7:
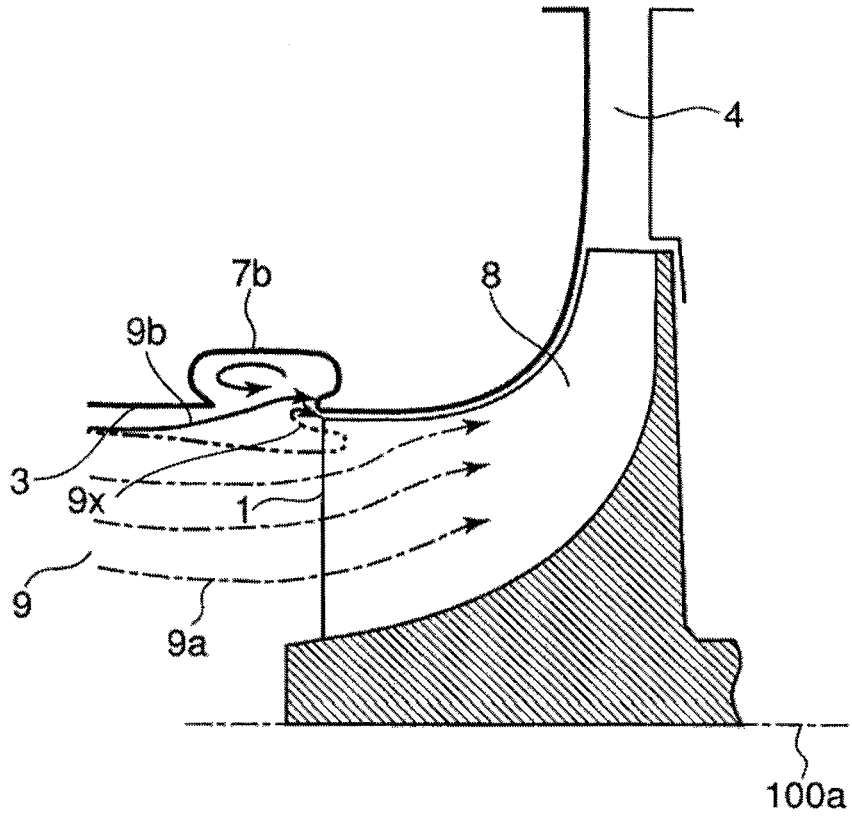
Fig. 7 PRIOR ART
FIG. 7 is a sectional view of an essential section of a radial compressor of an exhaust turbo-charger illustrating a conventional comparison example.
Figure 8:
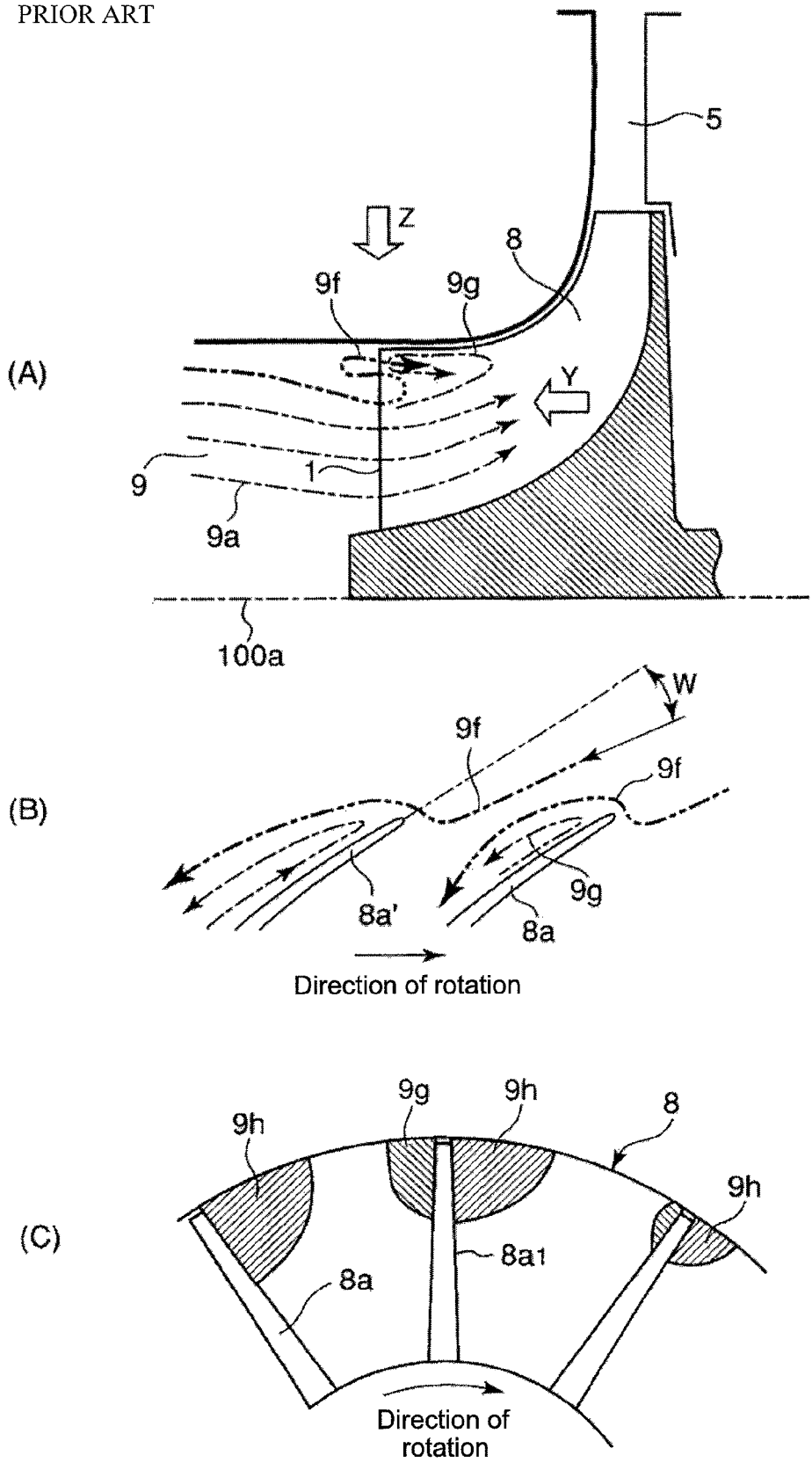
Fig. 8 PRIOR ART
FIG. 8(A) is a sectional view of an essential section of a radial compressor of an exhaust turbo-charger illustrating a prior art, (B) is a graphical illustration of flows at the distal end portion of a blade (Z fragmentary view), and (C) is a Y fragmentary view of (A)
Figure 9:
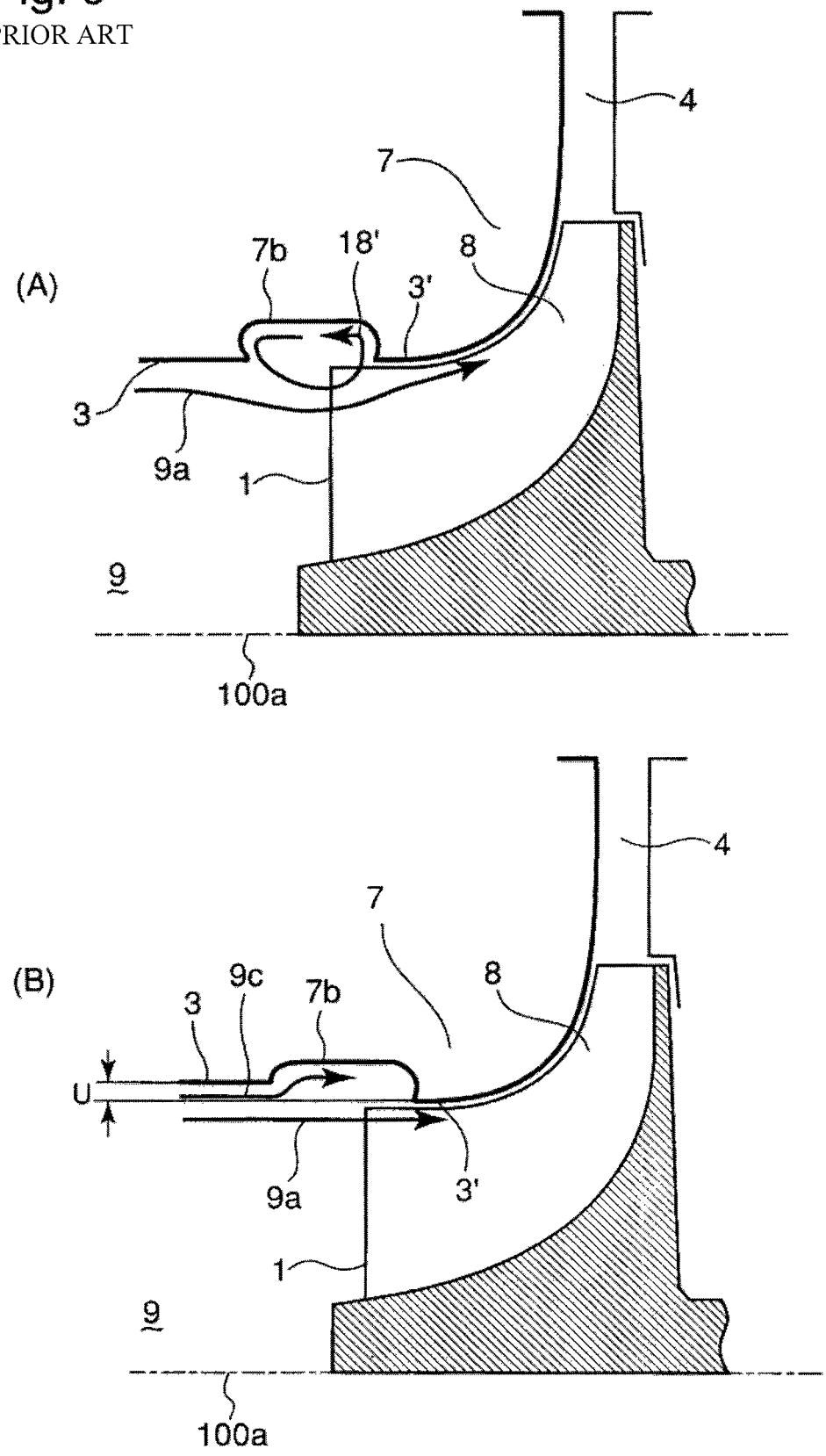
Fig. 9 PRIOR ART
FIG. 9(A) is a first sectional view of an essential section of a radial compressor of an exhaust turbo-charger in Patent Document 1, and (B) is a second sectional view thereof.
Figure 10:
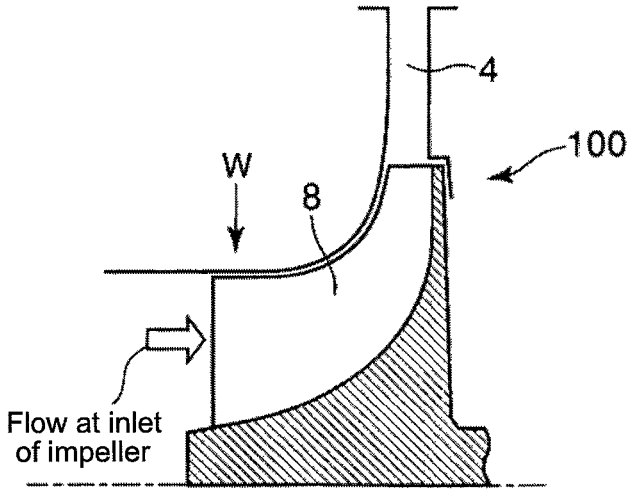
Fig. 10 PRIOR ART
FIG. 10(A) is a sectional view of an essential section of a radial compressor of an exhaust turbo-charger according to a prior art, (B) is a performance diagram, and (C) is an operational diagram of an end surface of a blade.
Figure 10:
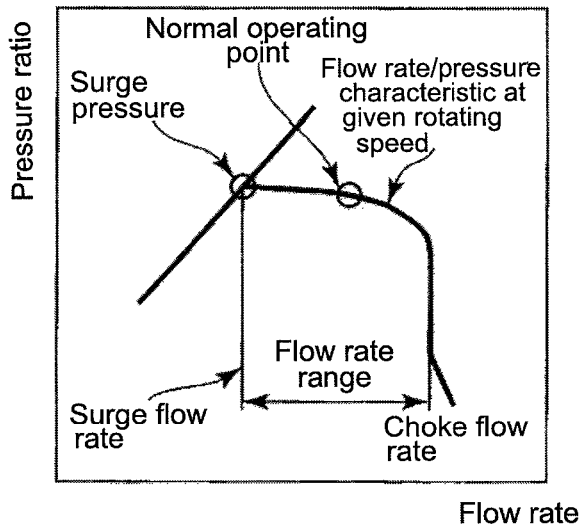
Fig. 10 PRIOR ART
Figure 10:
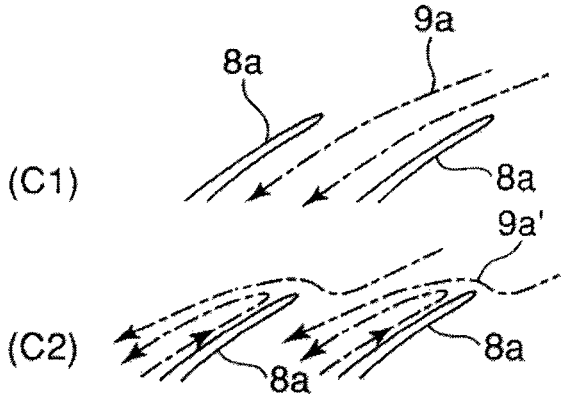
Fig. 10 PRIOR ART

Reversely from the above, if the axial projecting amount is set to be larger than 1.5T (X>1.5T), and if the meeting angle α at the connected portion exceeds 45°, then a flow in the vicinity of the annular concave groove 7*b* of the housing peripheral wall 3 will stagnate as indicated by 9*b* in FIG. 7, and the pressure of that portion will increase to a stagnant pressure, so that a flow 9*x* which moves around the blade front edge will be pushed back by the pressure and moves back in the blade 8*a* again, thus preventing an expected effect from being obtained.

With the construction described above, the first embodiment of the present invention makes it possible to prevent the separation from expanding at the reversely rotating blade 8*a*' caused by a flow running around the blade front end surface 1 of the blade 8*a*, thus permitting a surge flow rate to be reduced.

Second Embodiment

Figure 4:
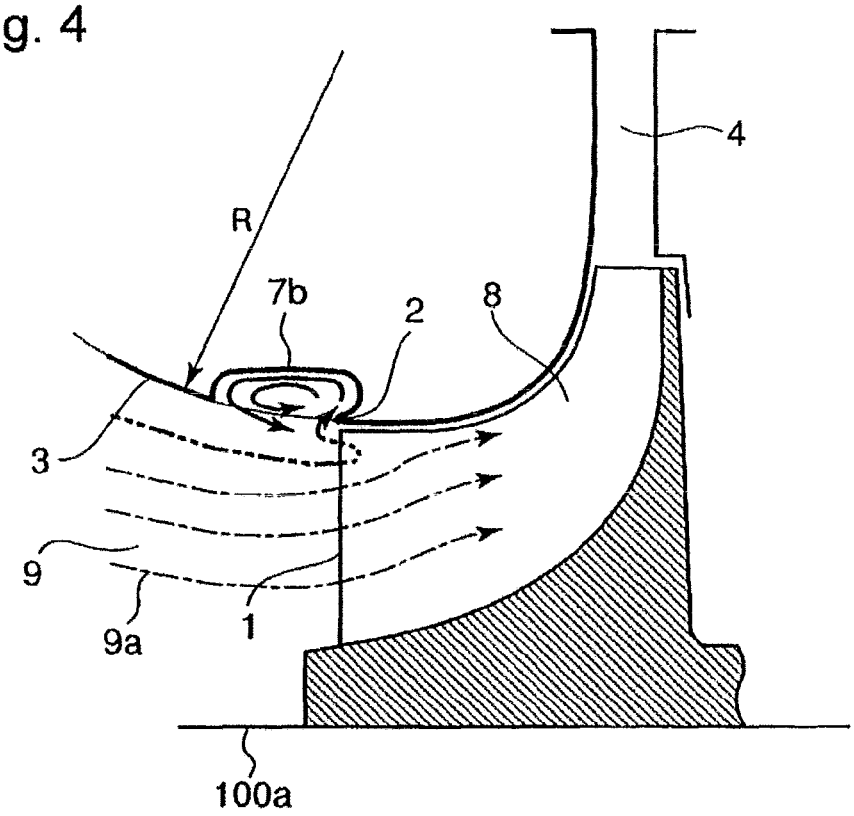
FIG. 4 is a sectional view of an essential section of a radial compressor of an exhaust turbo-charger according to a second embodiment of the present invention.

Further, FIG. 4 is a sectional view of an essential section of a radial compressor of an exhaust turbo-charger according to a second embodiment. In the second embodiment, a housing peripheral wall 3 in communication with the aforesaid annular concave groove 7*b* is formed into a curved surface having a radius R. The rest of the construction is the same as the construction of the aforesaid first embodiment, and the same components as those in the first embodiment are assigned the same reference numerals.

Third Embodiment

Figure 5:
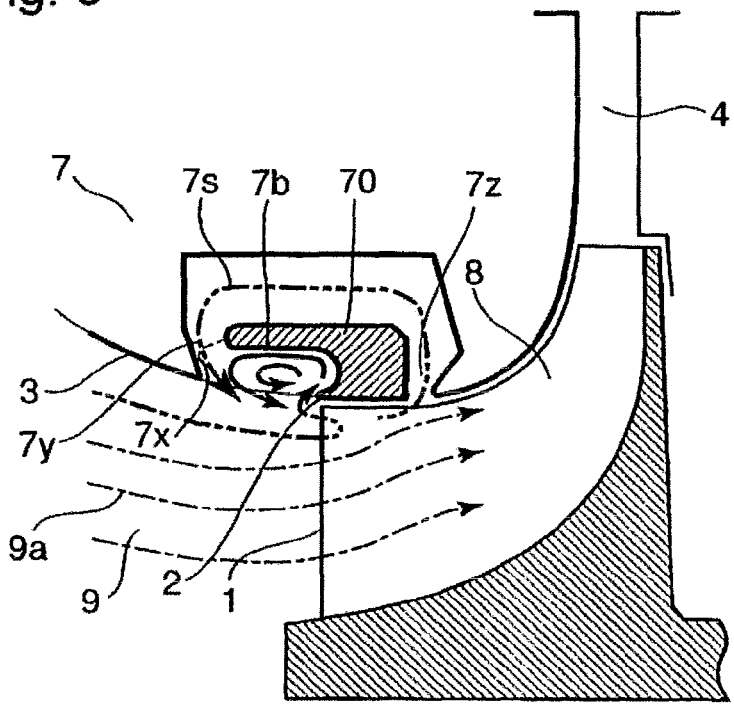
FIG. 5 is a sectional view of an essential section of a radial compressor of an exhaust turbo-charger according to a third embodiment.

FIG. 5 is a sectional view of an essential section of a radial compressor of an exhaust turbo-charger according to a third embodiment.

The third embodiment of the present invention has an opening 7*z* at a middle between a blade front end surface 1 of an impeller 8 and an impeller outlet, and an opening 7*y* at an upstream side from the blade front end surface 1 of the impeller 8, and includes a recirculation passage 7*s* which brings the two openings 7*z* and 7*y* in communication. Further, an annular component 70 is installed inside the recirculation passage 7*s* so as to be able to form the recirculation passage 7*s*. Inside the annular component 70, an annular concave groove 7*b* and an upstream end wall 7*x* (the virtual line indicated by the dashed line in the figure) thereof are formed such that they share an upstream-side wall surface of the opening 7*y* on the upstream side of the impeller of the recirculation passage 7*s*.

More specifically, a housing peripheral wall 3 of an air inlet passage 9 formed in the aforesaid compressor housing 7 includes the recirculation passage 7*s* around the outer periphery of the annular component 70 and the annular concave groove 7*b* along the inner periphery of the annular component 70, and an opening rear end portion 2 in the annular concave groove 7*b* is provided in the vicinity of the front end surface 1 of the impeller 8.

As with the aforesaid first embodiment, in the third embodiment also, the opening rear end portion 2 of the annular concave groove 7*b* along the inner periphery of the annular component 70 is formed such that the axial projecting amount X relative to the blade front end surface 1 of the impeller 8 is set to be $-1T \leqq X \leqq 1.5T$ (where T denotes the thickness of a blade distal end portion), and the section including the axis of the opening rear end portion 2 of the annular concave groove 7*b* is formed such that a rear end internal surface of the annular concave groove 7*b* and the housing peripheral wall 3 are connected, forming a pointed end of an acute angle, and that a meeting angle α formed by the rear end internal surface of the annular concave groove and the internal peripheral wall surface of the housing at the connected portion does not exceed 45°.

The present embodiment is an example of a combination with a recirculation passage conventionally used. Recirculation has been in frequent practical use because of its remarkable effect for reducing a surge flow rate. The recirculation, however, has been posing a shortcoming in that, after an impeller has imparted work to a flow, the work turns into a loss during a recirculation process, thus deteriorating efficiency. However, applying the construction which combines the recirculation passage and the annular concave groove, as with the third embodiment, allows the effect for reducing a surge flow rate to be obtained by the action of recirculation in the annular concave groove. Hence, the passage sectional area of the recirculation passage can be reduced, making it possible to achieve further reduced deterioration of efficiency, as compared with a case where the recirculation is used alone.

Further, according to the third embodiment, as with the first embodiment, applying a shape, which is similar to that of the opening rear end portion 2 of the annular concave groove 7*b*, to the opening 7*z* of the recirculation passage 7*s* reduces the stagnant pressure at the opening 7*z*, permitting an easy flow into the recirculation passage 7*s*, and the effect for reducing the pressure in the recirculation passage 7*s* can be obtained, leading to improved efficiency due to recirculation.

INDUSTRIAL APPLICABILITY

According to the present invention, it is possible to provide a radial compressor capable of preventing the occurrence of separation caused by a flow which goes beyond the front end of a blade and turns onto a negative pressure plane from a pressure plane, thereby reducing a surge flow rate to a smaller flow rate.

The invention claimed is:

1. A radial compressor: comprising an impeller which is rotatively driven, axially introduces air taken in through an air passage formed in a housing, pressurizes the introduced air, and discharges the pressurized air in a radial direction; and an annular concave groove being formed in a peripheral wall of the air passage of the housing;

wherein a rear end portion of an opening of the annular concave groove, which the rear end portion meets a housing peripheral wall, is provided in the vicinity of a blade front end surface of the impeller and the rear end portion of the opening of the annular concave groove is formed such that an axial projecting amount X thereof relative to the blade front end surface of the impeller is defined by $-1T \leqq X \leqq 1.5T$ where T denotes the thickness of the distal portion of a blade.

2. The radial compressor according to claim 1, wherein a shape of the rear end portion of the opening of the annular concave groove in a cross section including an axis is formed such that a rear end internal surface of the annular concave groove and the peripheral wall surface of the housing are connected, forming a pointed end with an acute angle, and that a meeting angle $\alpha$ formed by the rear end of internal surface of the annular concave groove and the inner peripheral wall surface of the housing at the connected portion is not less than 0° and not more than 45°.

3. The radial compressor according to claim 1, wherein the thickness of the projecting end of the connected portion of the rear end internal surface of the annular concave groove and the inner peripheral wall surface of the housing is set to not less than 1T and not more than 1.5T.

4. The radial compressor according to claim 1, wherein the annular concave groove is formed in the inner peripheral portion of an annular component having a recirculation passage formed on the outer periphery side thereof, the recirculation passage connecting an opening that opens to the outer periphery of a middle portion of an outlet of the impeller and an opening that opens to an outer peripheral portion at an upstream side beyond a blade front end surface at the outlet of the impeller.

* * * * *